US007025326B2

(12) United States Patent
Lammert et al.

(10) Patent No.: US 7,025,326 B2
(45) Date of Patent: Apr. 11, 2006

(54) HYDRAULIC VALVE ACTUATION METHODS AND APPARATUS

(75) Inventors: Michael P. Lammert, Woodland Park, CO (US); Miguel Angelo Raimao, Manitou Springs, CO (US); Daniel D. Giordano, Colorado Springs, CO (US); Christopher Wayne Turner, Windsor, CO (US); Christopher Stevens Balton, Manitou Springs, CO (US); Guy Robert Babbitt, Colorado Springs, CO (US)

(73) Assignee: Sturman Industries, Inc., Woodland Park, CO (US)

( * ) Notice: Subject to any disclaimer, the term of this patent is extended or adjusted under 35 U.S.C. 154(b) by 142 days.

(21) Appl. No.: 10/618,061

(22) Filed: Jul. 11, 2003

(65) Prior Publication Data

US 2004/0065854 A1 Apr. 8, 2004

Related U.S. Application Data

(60) Provisional application No. 60/395,370, filed on Jul. 11, 2002.

(51) Int. Cl.
*F16K 21/04* (2006.01)

(52) U.S. Cl. ..... 251/29

(58) Field of Classification Search ..... 21/29, 21/30.01–30.05; 123/90.12
See application file for complete search history.

(56) References Cited

U.S. PATENT DOCUMENTS 4,724,801 A 2/1988 O'Neill
5,224,683 A * 7/1993 Richeson ..... 251/30.01
5,248,123 A * 9/1993 Richeson et al. ..... 251/29
5,339,777 A * 8/1994 Cannon ..... 123/90.12
5,531,192 A * 7/1996 Feucht et al. ..... 123/90.12
5,829,396 A 11/1998 Sturman
6,067,946 A 5/2000 Bunker et al.
6,148,778 A 11/2000 Sturman
6,308,690 B1 10/2001 Sturman
6,315,265 B1 11/2001 Adler et al.
6,360,728 B1 3/2002 Sturman
6,557,506 B1 5/2003 Sturman

FOREIGN PATENT DOCUMENTS

DE 3911495 C1 8/1990
DE 4209590 C1 5/1993

* cited by examiner

*Primary Examiner*—Justine R. Yu
*Assistant Examiner*—Huyen Le
(74) *Attorney, Agent, or Firm*—Blakely, Sokoloff, Taylor & Zafman LLP

(57) ABSTRACT

Hydraulic engine valve actuation methods for internal combustion engines having improved energy efficiency. In hydraulic engine valve operating systems using spring returns for valve closure, the spring force is a minimum when the valve is closed and a maximum at the maximum lift. The present invention takes advantage of this difference by using a valve opening hydraulic force which is greater than the spring force when the valve is closed and less than the spring force when the valve is open at its maximum lift. The valve actuator is controlled to allow the valve, when opening, to overshoot the equilibrium condition. During the overshoot, the hydraulic actuator backfills with actuating fluid at it normal actuating pressure. When the valve velocity decays to zero or near zero, the flow of hydraulic fluid to (and from) the valve actuator may be cut off, capturing the valve substantially at the overshoot position.

21 Claims, 2 Drawing Sheets

HYDRAULIC VALVE ACTUATION METHODS AND APPARATUS

CROSS-REFERENCE TO RELATED APPLICATION

This application claims the benefit of U.S. Provisional Patent Application No. 60/395,370 filed Jul. 11, 2002.

BACKGROUND OF THE INVENTION

1. Field of the Invention

The present invention relates to the field of hydraulic intake and exhaust valve actuation methods and apparatus for internal combustion engines.

2. Prior Art

At the present time, piston-type internal combustion engines of interest to the present invention are widely used in automobiles, trucks, buses and various other mobile and stationary power systems. Such engines include the common gasoline and diesel engines, as well as similar engines operating from alternative fuels such as liquid natural gas. These engines commonly utilize intake and exhaust valves that are spring loaded to the closed position and which are directly or indirectly opened at appropriate times by a camshaft mechanically driven from the engine crankshaft.

Camshaft actuation of engine valves historically has had a number of advantages, resulting in its relatively universal use in such engines for many decades. These advantages include high reliability, particularly given the current level of development of such cam actuated valve systems. Cam actuation is also relatively cost effective, again given the state of development and quantities in which it is produced.

However, engine valve systems are facing more and more challenges of increasing concern. In particular, optimal valve timing and lift are not fixed throughout the engine operating range. For instance, optimal valve timing and lift for maximum power at one engine speed will not be the same as optimal valve timing and lift for maximum power at another engine speed. Accordingly, the classic cam operated valve systems utilize a compromised valve timing and lift, providing compromised performance over a certain range of engine operating conditions while being less than optimal for most, if not at all, these conditions. Further, valve timing and lift for maximum power at any engine speed may not be optimal from an engine emissions standpoint. Optimum valve timing and lift at any given engine speed may need to be dependent on other dynamic engine parameters, such as one or more of engine loading, air temperature, air pressure, engine temperature, etc.

Recently, various hydraulic systems for engine intake and exhaust valve actuation have been proposed. These systems offer the potential of more flexible control of valve actuation parameters over the range of the various engine and environmental operating parameters, as their control, such as electronic control, is not subject to the constraints normally imposed by mechanical valve actuation systems. However, care should be taken to minimize the power consumption in hydraulic intake and exhaust valve actuation systems to achieve the potential advantages of such systems while minimizing power losses in the valve actuation systems.

The present invention is an improvement on hydraulic systems for engine intake and exhaust valve actuation.

BRIEF SUMMARY OF THE INVENTION

Hydraulic engine valve actuation methods for internal combustion engines having improved energy efficiency are disclosed herein. In hydraulic engine valve operating systems using a spring return for valve closure, the spring force is a minimum when the valve is closed and a maximum at the maximum lift. The present invention takes advantage of this difference by using a valve opening hydraulic force which is greater than the spring force when the valve is closed and less than the spring force when the valve is open at its desired lift. The valve actuator is controlled in such a way as to allow the valve, when opening, to overshoot the equilibrium condition wherein the hydraulic force equals the valve spring force. During the overshoot, the hydraulic actuator backfills with actuating fluid at it normal actuating pressure, so that the force decelerating the valve is the difference between the hydraulic force and the spring force. When the valve velocity decays to zero or near zero, the flow of hydraulic fluid to (and from) the valve actuator may be cut off, capturing the valve substantially at the overshoot position. This allows operation of the hydraulically operated valve using a lower pressure hydraulic fluid supply, conserving hydraulic energy and providing automatic valve deceleration to zero velocity at its maximum lift. The same method may be used for various hydraulically operated engine valve systems, including single stage and two stage systems.

DETAILED DESCRIPTION OF THE PREFERRED EMBODIMENTS

In a typical piston-type internal combustion engine having intake and exhaust valves, each with an engine valve return spring, the engine valve return springs are preloaded to provide the desired engine valve closing forces. These forces generally include a predetermined minimum force to hold the engine valve closed to prevent leakage, particularly after the compression and the power strokes. Also, in cam driven engine valve systems, the engine valve return springs must provide adequate forces throughout the engine valve motion to assure that the engine valve and engine valve drive system (cam follower, etc.) actually follow the profile defined by the cam, and do not float free of the cam at high engine speeds, as floating causes loss of power and can damage or destroy the engine valve or parts of the engine valve drive system.

In hydraulic engine valve drive systems, the engine valve return spring requirements are similar, as the required spring force to hold an engine valve closed is similar to that of a comparable cam actuation system, and the spring forces when the engine valve is open must be adequate,to decelerate the engine valve as it slows on approaching its desired lift, and to later adequately accelerate the engine valve toward its closed position at high engine speeds to allow closure in a timely manner. In a typical spring return intake and exhaust valve, the return spring deflection (preload) in the engine valve closed position is on the order of one half the return spring deflection at maximum engine valve lift (maximum engine valve open position), and thus the return spring force at maximum engine valve lift is on the order of twice the return spring force at the engine valve closed position. The present invention takes advantage of that difference in return spring force to reduce the hydraulic energy required to operate a hydraulic engine valve actuation system.

Figure 1:
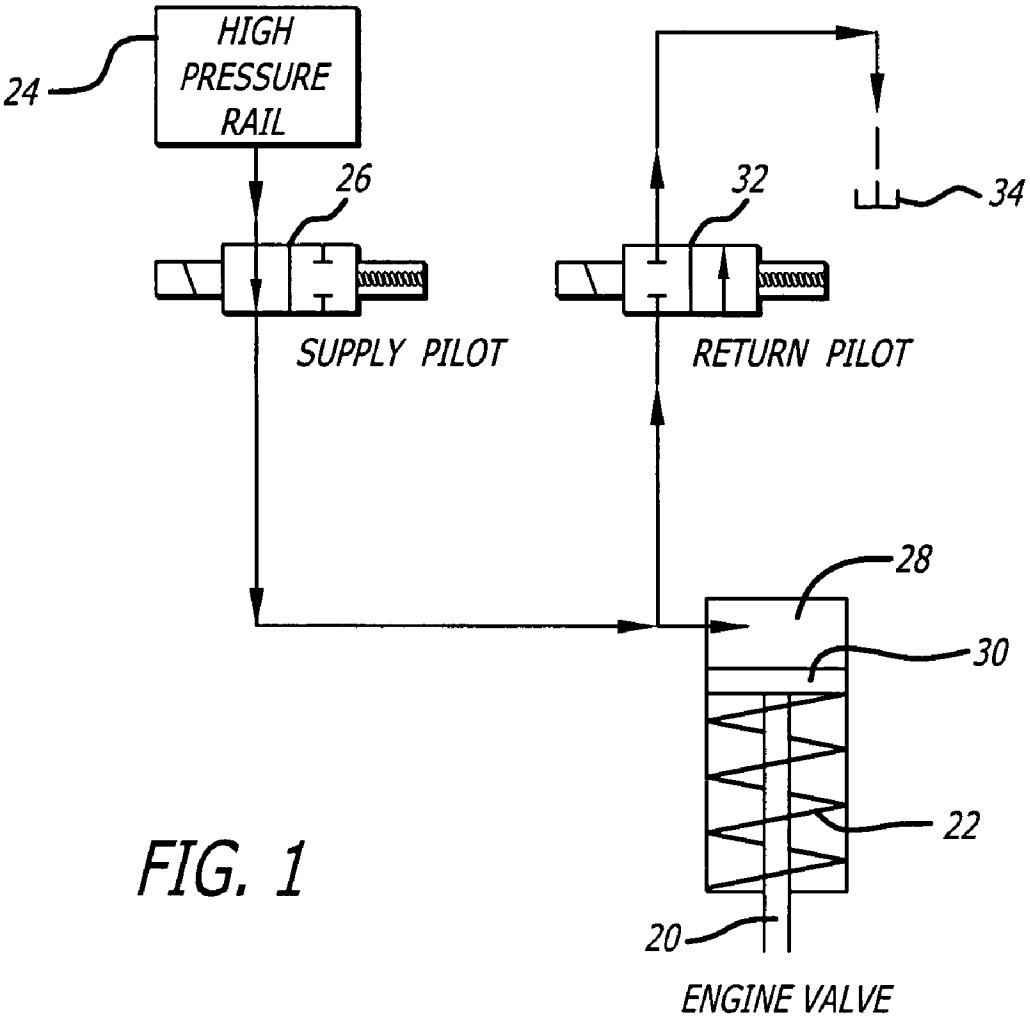
FIG. 1 is a block diagram of an exemplary embodiment of a single stage hydraulic engine valve operating system that may be operated in accordance with the present.

Now referring to FIG. 1, one exemplary embodiment of the present invention may be seen. As shown therein, an engine valve 20, which may be an intake valve or an exhaust valve, is spring loaded upward by an engine valve return spring 22 to an engine valve closed position. A fluid, typically engine oil, though other fluids may be used if desired, is provided under pressure from a high pressure rail 24, with a 2-way, 2-position supply pilot valve 26 controllably providing the high pressure fluid to the hydraulic cylinder 28 within which the piston 30 operating the engine valve 20 resides. A return pilot valve 32 is coupled between the cylinder 28 and a drain or return 34, typically at a low pressure, such as atmospheric pressure or a somewhat higher pressure. When the engine valve 20 is to be opened, the return pilot valve is closed and the supply pilot valve 26 is opened, coupling the high pressure rail to the cylinder 28 to open the engine valve 20. When the engine valve 20 is to be closed, the supply pilot valve 26 is closed and the return pilot valve 32 is opened, coupling the cylinder 28 to the return 34 to close the engine valve 20.

In the prior art, the maximum engine valve lift is generally determined by the engine valve opening at which the hydraulic force (high pressure rail pressure times the area of the valve actuation piston 30) equals the spring force of engine valve spring 22. This is because the hydraulic fluid flow may be throttled as the engine valve 20 approaches its maximum lift, slowing the engine valve until captured with the valve spring force equaling the hydraulic force opening the valve. This dissipates the energy in the moving engine valve and substantially avoids hydraulic oscillation.

With the present invention, the engine valve may be opened to a position where the spring force of engine valve spring 22 exceeds the hydraulic force that opened the engine valve. In particular, the high pressure rail 24 is set to a pressure lower than that necessary to equilibrate the engine valve return spring 22 at the desired lift, but higher than that required to initiate opening of the engine valve 20. On initial opening, the engine valve 20 is accelerated toward the full open position. The supply pilot valve 26 is kept open to allow the engine valve 20 to overshoot the lift at which the rail pressure and the engine valve spring 22 would supply equal but opposite forces on the engine valve 20. The overshoot occurs due to the fact that the engine valve 20 has not been decelerated to a velocity of zero at this lift and therefore still has momentum that will carry the engine valve 20 to a higher lift. As the engine valve 20 travels to this higher lift, the volume swept by valve actuating piston 30 is backfilled with fluid at the pressure of high pressure rail 24, so that the decelerating force is equal to the difference in the spring force and the hydraulic force, and not the spring force alone.

When the velocity of engine valve 20 reaches approximately zero, the supply pilot valve 26 is closed. The pressure of the fluid in cylinder 28 at this point is less than that required to equilibrate the force of the valve spring 22. As a result, the engine valve 20 will move slightly toward the closed direction until the pressure increases enough to equilibrate the force of the valve spring 22. Still, the engine valve 20 has opened to a desired lift using a rail pressure less than what is required to equilibrate the valve spring 22 at that lift. Because the hydraulic energy used is equal to the product of the volume of fluid used to open the engine valve 20 and the pressure of the fluid used, the ability to use a lower pressure fluid for the desired engine valve lift results in more energy efficient operation of the engine valve 20 than the prior art equilibrium force strategy.

Because when the velocity of engine valve 20 reaches approximately zero and the supply pilot valve 26 is closed, the pressure of the fluid in cylinder 28 is less than that required to equilibrate the force of the valve spring 22, there may be a small amount of hydraulic oscillation. However, any increased wear caused by such oscillation should be minimal because of the ability to provide a coaxial arrangement of the engine valve 20 and the valve actuating piston 30 (unlike a rocker arm valve actuator), and any noise created by the oscillation should be held to a minimum by appropriate design.

Figure 2:
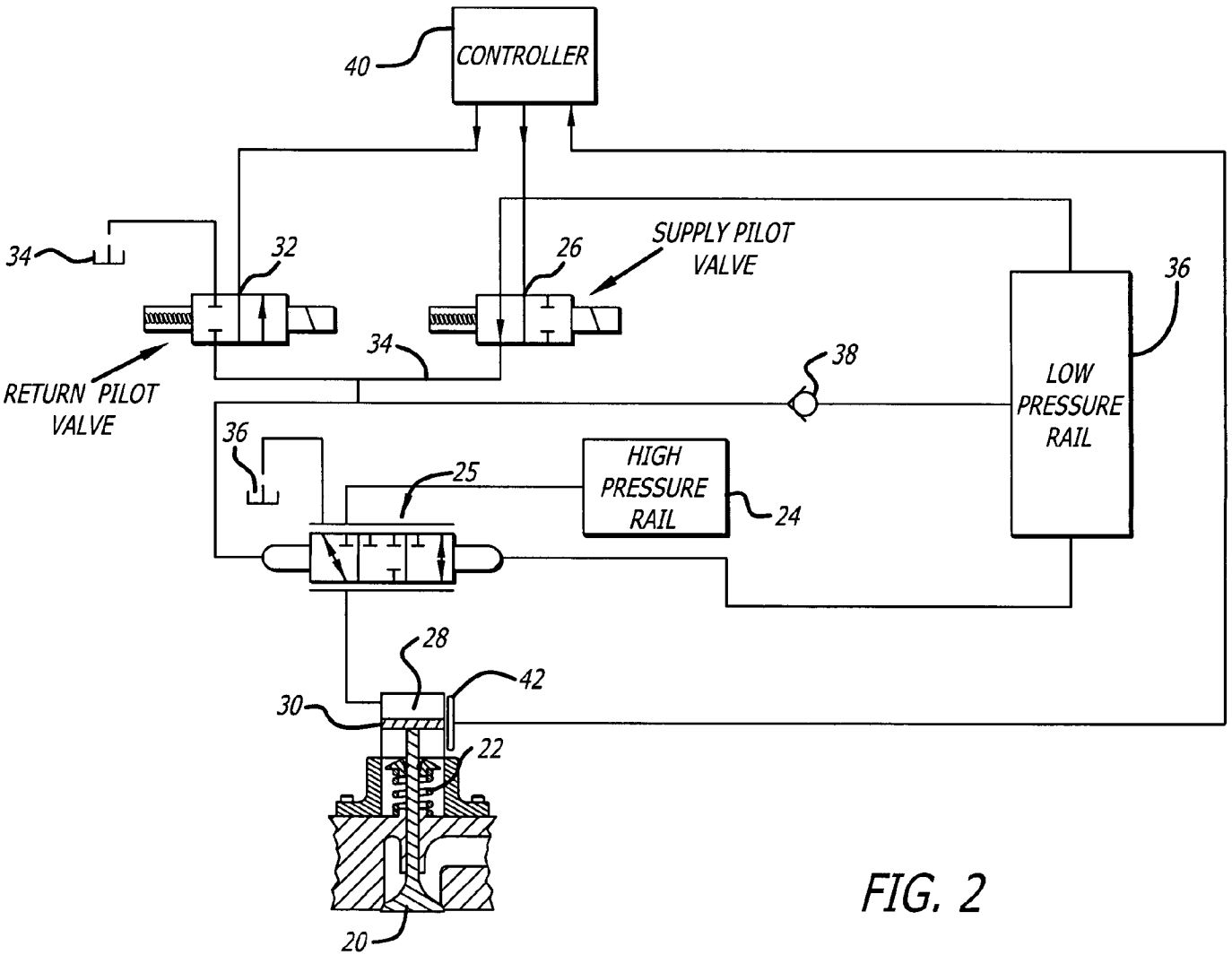
FIG. 2 is a block diagram of an exemplary embodiment of a two stage hydraulic engine valve operating system that may be operated in accordance with the present.

The foregoing is an illustration of the application of the present invention to what is referred to herein as a single stage system. The invention is also applicable to other systems, such as two stage systems, an example of which is shown in FIG. 2. As may be seen in this Figure, the proportional valve, generally indicated by the numeral 25, may controllably couple the high pressure rail 24 to the cylinder 28 in which the valve actuating piston 30 resides, or may controllably couple the cylinder 28 to the return or vent 36, dependent upon the position of the proportional valve.

In the embodiment illustrated, the proportional valve 25 is a spool valve, wherein the spool position itself is hydraulically controlled. Specifically, as shown in FIG. 2, the right end of the spool or spool assembly is exposed to the pressure in the low pressure rail 36. The left end of the spool-or spool assembly may be exposed to the pressure of the low pressure rail 36 through supply pilot valve 26 to a fixed volume of fluid (both pilot valves 26 and 32 being closed), or to return 34 through return pilot valve 32. In that regard, in this embodiment, the left end of the spool or spool assembly in the proportional valve 25 has a larger area exposed to the fluid pressure than the right end of the spool or spool assembly. Therefore the spool assembly will move to the right when both ends are exposed to the pressure in the low pressure rail 36, though the spool will move to the left when the left end is vented to the return 34 through return pilot valve 32. For this purpose, the spool of the proportional valve may have a piston at one end of a different diameter than the spool itself, or pistons of different sizes may be used at both ends of the spool to achieve the hydraulic area differences. In a preferred embodiment, the effective hydraulic area of the left end of the spool is approximately twice that of the right end of the spool.

In operation, closing the return pilot valve 32 and opening of the supply pilot valve 26 provides fluid from the low pressure rail 36 to the proportional valve 25, moving the spool to the right, which couples cylinder 28 to the vent or return 36 (which may be the same as or different from the return 34), allowing the valve spring 22 to hold the valve 20 in the closed position. When the supply pilot valve 26 is closed and the return pilot valve 32 is opened, the pressure from the low pressure rail 36 moves the spool toward the left, first closing the flow path from cylinder 28 to the return 36 and then opening the flow path between the high pressure rail 24 and cylinder 28 to open the engine valve 20.

In a preferred embodiment of such a two-stage system, the proportional valve 25 may be controllably positioned, as desired, through appropriate control of the supply pilot valve 26 and return pilot valve 32. The proportional valve itself is configured to block all flow when the spool is centered therein, plus or minus approximately 10% of its travel. The flow area from the high pressure rail 24 or to the return 36, depending upon the direction of motion of the spool from the central blocked position, increase first at a relatively low rate with spool position, and then increase more rapidly with spool position until the maximum flow rates are achieved. In this way, maximum flow areas may be commanded, as desired, though low flow rates and no flow rate may be readily commanded without requiring special precision in the positioning of the spool of the proportional valve 25. Check valve 38 damps hydraulic oscillation and provides some energy recovery whenever the return pilot valve 32 is closed quickly before the spool in the proportional valve 25 reaches its left-most position by coupling any pressure spike to the low pressure rail 36.

In the operation of the system of FIG. 2, a sensor 42 such as a Hall effect sensor senses valve position to provide position information to the controller 40, which controls the electromagnetically actuated pilot valves 26 and 32. With the engine valve 20 in the closed position, the spool of the proportional valve 25 may be moved to the right-most position to provide maximum coupling between cylinder 28 and return 36, and to provide a known starting point for the spool of the proportional valve so that incremental errors do not accumulate, valve event to valve event.

The proportional valve 25 provides the ability to relatively accurately control the flow areas between the high pressure rail 24 and cylinder 28, and between cylinder 28 and return 36, from zero to maximum flow areas. This allows supply pilot valve 26 and the return pilot valve 32 to be controlled by controller 40 to control the time and rate of initial engine valve opening, the rate of acceleration toward maximum lift, the deceleration prior to maximum lift, and the dwell at maximum lift. It also allows supply pilot valve 26 and the return pilot valve 32 to be controlled by controller 40 to control the rate of acceleration toward engine valve 20 closure, the deceleration as the engine valve 20 approaches closure, and the final closure rate of the engine valve 20. The sensor 42 provides a feedback to the controller 40, generally a processor based controller, to make any adjustments in the current valve event and for the next valve event to correct any deviation in valve motion from that desired for the existing engine operating and environmental conditions.

In one mode of operation, the proportional valve 25 is controlled so that as the engine valve 20 approaches its maximum lift position, the proportional valve 25 limits the flow from the high pressure rail 24 to the cylinder 28 to decelerate the engine valve 22. The engine valve stops when the pressure from the high pressure rail 24, as applied to the valve actuating piston 30, matches the spring force of spring 22. This positively determines engine valve position and avoids hydraulic oscillation at the beginning of engine valve dwell at maximum lift.

In the present invention, the proportional valve 25 is not used to significantly throttle or limit the flow area between the high pressure rail 24 and cylinder 28 as the engine valve 20 proceeds toward its open position. Instead, as with the embodiment of FIG. 1, the full flow from the high pressure rail 24 to the cylinder 28 may be continued until the engine valve 20 stops at its maximum lift position. Then when the engine valve 20 stops, the spool of the proportional valve 25 is moved to a central position, blocking further flow from the high pressure rail 24 to (or from) cylinder 28. At this point, as with the embodiment of FIG. 1, the force from the valve return spring 22 will exceed the hydraulic force caused by the pressure of the high pressure rail 24 on valve actuating piston 30, resulting in some slight hydraulic oscillation. However, as previously described, this oscillation can be made of little consequence. Some throttling can be used in order to account for differences in engine valve motion from valve to valve due to differences in engine valve spring tolerances, manufacturing tolerances, etc. Thus throttling may be used to some extent to make all the engine valves open and close the same way, if desired.

It should be noted that as the engine valve 20 closely approaches its maximum lift or is just beyond its maximum lift, the engine valve 20 velocity is very low.

Consequently, movement of the spool of the proportional valve 25 to a central position to block further flow from the high pressure rail 24 to (or from) cylinder 28 when the engine valve 20 stops need not be exactly when the engine valve 20 stops, which is easily detected by the valve sensor 42.

In theory, when opening, an engine valve could accelerate toward the open position during the first half of its travel based on a positive unbalance of the hydraulic valve opening force versus the valve return spring force, and decelerate to the maximum lift position during the second half of its travel due to a negative balance between the hydraulic force and the valve return spring force. For a system wherein the valve return spring force at the desired lift is twice the valve return spring force in the engine valve closed position, this would mean that theoretically, the hydraulic force would need to equal three-fourths of the engine valve return spring force at maximum valve lift, rather than the full engine valve return spring force. This offers a potential energy savings of 25%. While hydraulic and other losses will reduce this energy savings, significant power consumption reduction can still be achieved using the present invention without additional mechanical or electronic complexity, as the present invention is more a matter of control than of additional mechanical or electronic apparatus. The present invention may also be used in engines using both a return spring and a hydraulic return on the engine valves.

The supply pilot valves 26 and the return pilot valves 32 of the embodiments of FIGS. 1 and 2 may be solenoid operated spool valves. It should be understood, however, that the present invention is not dependent upon the specific design of the supply pilot valves and return pilot valves, or in the embodiment of FIG. 2, upon the specific design of the proportional valve 25, as other valves and other valve types may be used. By way of example, the two-way two-position valves used for the supply pilot valves 26 and return pilot valves 32 may, alternatively, be a single, three-position, three-way spool valve. Similarly, the supply pilot valves and return pilot valves may be poppet valves or still some other form of valve. The proportional valve 25 may use a spring on one end of the spool, rather than or in addition to the hydraulic return driven by the pressure of the low pressure rail 36, the spring acting in a direction to encourage the spool of the proportional valve to the position venting the cylinder 28 as a fail safe feature of the invention. As a further alternative, other types of valves may be used in place of the spool type proportional valve 25 of FIG. 2 without departing from the invention. Thus, the disclosure of the specific embodiments of FIGS. 1 and 2 has been for purposes of illustration and not for purposes of limitation, as the present invention is not limited to use with pilot valves and/or proportional valves and/or valves of other types of any specific configuration. The valves useable with the present invention also need not have any specific mode of operation, as non-latching as well as magnetically latching valves may be used as desired. Thus, while certain embodiments of the present invention have been disclosed and described herein, it will be apparent to those skilled in the art that various changes in form and detail may be made therein without departing from the spirit and scope of the invention.

What is claimed is:

1. A method of opening an engine valve having a hydraulic actuator to open the engine valve and a return spring for closing the engine valve comprising:

coupling the hydraulic actuator to a source of fluid under pressure to accelerate the engine valve toward the engine valve open position;

continuing to couple the hydraulic actuator to the source of fluid under pressure as the engine valve closing force of the return spring starts to exceed the engine valve opening force of the hydraulic actuator; and, decoupling the hydraulic actuator from the source of fluid under pressure as the engine valve stops at an engine valve opening wherein the engine valve closing force of the return spring exceeds the engine valve opening force of the hydraulic actuator.

2. The method of claim 1 wherein the hydraulic actuator is coupled to the source of fluid under pressure through a pilot valve.

3. The method of claim 2 wherein the pilot valve is a spool valve.

4. The method of claim 1 wherein the hydraulic actuator is coupled to the source of fluid under pressure through a proportional valve, the proportional valve being hydraulically controlled by electrically controlled valving.

5. The method of claim 4 wherein the proportional valve is a spool valve.

6. The method of claim 1 wherein the hydraulic actuator and the return spring are coaxial with the engine valve.

7. The method of claim 1 wherein the hydraulic actuator is coupled to the source of fluid under pressure through a valve hydraulically controlled by electrically controlled valving.

8. A method of opening an engine valve having a hydraulic actuator to open the engine valve and a return spring for closing the engine valve comprising:

coupling the hydraulic actuator to a source of fluid under pressure to accelerate the engine valve toward the engine valve open position;

continuing to couple the hydraulic actuator to the source of fluid under pressure as the engine valve closing force of the return spring starts to exceed the engine valve opening force of the hydraulic actuator; and, blocking flow to and from the hydraulic actuator as the engine valve stops at an engine valve opening wherein the engine valve closing force of the return spring exceeds the engine valve opening force of the hydraulic actuator.

9. The method of claim 8 wherein the hydraulic actuator is coupled to the source of fluid under pressure through a pilot valve.

10. The method of claim 9 wherein the pilot valve is a spool valve.

11. The method of claim 8 wherein the hydraulic actuator is coupled to the source of fluid under pressure through a proportional valve, the proportional valve being hydraulically controlled by electrically controlled valving.

12. The method of claim 11 wherein the proportional valve is a spool valve.

13. The method of claim 8 wherein the hydraulic actuator and the return spring are coaxial with the engine valve.

14. The method of claim 8 wherein the hydraulic actuator is coupled to the source of fluid under pressure through a valve hydraulically controlled by electrically controlled valving.

15. Engine valve apparatus comprising:

an engine valve;

an engine valve return spring disposed to urge the engine valve to a closed position;

a source of fluid under pressure;

a hydraulic actuator disposed to urge the engine valve to an open position;

valving for controllably coupling the source of fluid under pressure to the hydraulic actuator, for blocking fluid flow to and from the hydraulic actuator and for allowing fluid flow from the hydraulic actuator to a vent; and, a controller controlling the valving to couple the source of fluid under pressure to the hydraulic actuator until the engine valve stops at an engine valve opening at which the return force urging the engine valve toward the closed position exceeds the hydraulic force urging the engine valve toward the open position, then blocking fluid flow to and from the hydraulic actuator, and to allow fluid flow from the hydraulic actuator to the vent when the engine valve is to be closed.

16. The apparatus of claim 15 wherein the valving couples the hydraulic actuator to the source of fluid under pressure through an electrically controllable pilot valve.

17. The apparatus of claim 16 wherein the pilot valve is a spool valve.

18. The apparatus of claim 15 wherein the valving comprises a hydraulically controlled proportional valve and electrically controllable valving, the hydraulic actuator being coupled to the source of fluid under pressure through the proportional valve, the proportional valve being hydraulically controlled by the electrically controlled valving.

19. The apparatus of claim 18 wherein the proportional valve is a spool valve.

20. The apparatus of claim 15 wherein the hydraulic actuator and the return spring are coaxial with the engine valve.

21. The apparatus of claim 15, wherein the valving comprises a valve hydraulically controlled by electrically controlled valving.

* * * * *